United States Patent [19]

Pass

[11] Patent Number: 4,899,387

[45] Date of Patent: Feb. 6, 1990

[54] ACTIVE LOW FREQUENCY ACOUSTIC RESONANCE SUPPRESSOR

[75] Inventor: Nelson S. Pass, Auburn, Calif.

[73] Assignee: Threshold Corporation, Auburn, Calif.

[21] Appl. No.: 279,406

[22] Filed: Dec. 2, 1988

[51] Int. Cl.[4] ..... G10K 11/16

[52] U.S. Cl. ..... 381/71; 381/96

[58] Field of Search ..... 381/66, 71, 96

[56] References Cited

U.S. PATENT DOCUMENTS

| | | | |
|---|---|---|---|
| 2,160,638 | 5/1939 | Bedell et al. | 181/30 |
| 2,502,020 | 3/1950 | Olson | 181/33 |
| 4,455,675 | 6/1984 | Bose et al. | 381/74 |
| 4,473,906 | 9/1984 | Warnaka et al. | 381/71 |
| 4,589,133 | 5/1986 | Swinbanks | 381/71 |
| 4,683,590 | 7/1987 | Miyoshi et al. | 381/66 |
| 4,712,247 | 12/1987 | Swarte | 381/96 |
| 4,815,139 | 3/1989 | Eriksson et al. | 381/71 |

OTHER PUBLICATIONS

Harry F. Olson, *Acoustical Engineering*, pp. 415–416, 511.

Vern O. Knudsen, *Journal of the Acoustical Society*, Jul. 1932, pp. 20–37, entitled: "Resonance in Small Rooms".

*Primary Examiner*—Forester W. Isen

*Attorney, Agent, or Firm*—Thomas Schneck

[57] ABSTRACT

An electrically active sound wave attenuation apparatus mounted in an upright, free-standing housing for eliminating unwanted reflected waves in a room. The housing is intended to be placed in a location where undesired wave patterns, such as standing waves, are formed in order to offset or cancel such conditions. These conditions are offset by generating an acoustic signal which is the inverse of pressure waves at a particular location. The pressure waves are sensed by a module, including a microphone which generates a corresponding electrical signal. This signal is sent to an electrical circuit where an inverse signal is created which is then transmitted to a loudspeaker. The loudspeaker output is directed toward the location where the standing waves would be formed. The loudspeaker output nulls local acoustic waves so that no standing waves are formed. The housing may incorporate two acoustically isolated modules with resonance attenuating qualities, one at each end of the structure.

10 Claims, 2 Drawing Sheets

SOUND PRESSURE (dB)
FREQUENCY (HZ)
4' SPHERE
2' SPHERE
A
B

ACTIVE LOW FREQUENCY ACOUSTIC RESONANCE SUPPRESSOR

TECHNICAL FIELD

The invention relates to electrical apparatus for sound wave attenuation in defined acoustical zones.

BACKGROUND ART

In audio reproduction much effort has been expended in improving the faithful reproduction of an original event or performance. Every link in the reproduction chain carries the full responsibility for the integrity of the sound. Each component in the reproduction chain is scrutinized for flaws in handling the sonic information. The listening environment is a major component in this chain and is one of the most easily degraded components.

When considering just the amplitude and phase response distortion, a modern recording and playback system can deliver a signal from a microphone through the recording playback process to the output of an amplifier with less than two decibels (dB) of amplitude variation over the audio band. Loudspeakers display considerably less accuracy, but several still manage to deliver less than five dB variation at all but the lowest frequencies. A reasonably live rectangular room, however, is easily capable of amplitude variations of 20 dB, corresponding to an energy error of 10,000%.

These amplitude variations found in standard rooms skew the original amplitude and phase relations of the music and cause overhang and "boominess" in somewhat the same way as a poorly designed speaker enclosure distorts sound when driven by an amplifier with a very low damping factor. At frequencies below 200 Hz, the average listening room begins to behave like a classic rectangular chamber and exhibits large response variation due to standing waves. Standing waves develop between opposing corners and parallel surfaces where pressure can build up. The gravest of these resonances corresponds to the longest dimension of the room. In this resonance mode, an acoustic standing wave develops high cumulative energy with high pressure in the corners and high air velocity in the center of the room. Air cannot flow through the walls and pressure builds up in the corners much as it does in the throat of a horn. Not having a rectangular room does not mean that the resonant peaks do not develop.

Prior art solutions to this problem of standing wave resonance in listening rooms center around passive designs. One method would be to design a room wherein the worst resonant modes are avoided. However this would be impractical for existing rooms, and may be costly for new structures. A number of efforts have involved completely lining the room with absorbent foam, fiberglass or cloth to eliminate reflected sound, but this is not effective at the lower frequencies where the worst of the room variations exists. Even if it were possible to create a completely nonreflective environment, it would not solve the problem. Listening to audio in an anechoic chamber or dead room is not a very satisfying experience. Nor is it practical to line all of the surfaces of a room with sound absorbent materials.

In U.S. Pat. No. 2,160,638, Bedell et al. discloses a sound absorbing unit employing sound absorbing materials. The sound absorbing unit comprises a large thin perforated metal casing containing highly efficient sound absorbing material and is adapted to be mounted with both sides of the material exposed to the sound waves in a room. The perforations in the metal are small enough to be inconspicuous and are of such spacing as to make the casing substantially acoustically transparent.

In U.S. Pat. No. 2,502,020 Olson discloses an acoustic absorber having a casing which encloses a large volume of air. The wall structure of the casing is made up of a material which is previous to sound waves and which offers a high impedance thereto. The preferred material used for the casing is fiberglass. The acoustic absorber of Olson may be cylindrical in shape.

Active sound wave pressure reducers are known. In a book entitled "Acoustical Engineering" by H. F. Olson, D. Van Nostrand Co., Inc., pp. 415–417 and 511, there is a teaching of an active sound absorber featuring a microphone, amplifier and loudspeaker connected to reduce the sound pressure of acoustic waves in the vicinity of the microphone-loudspeaker.

It is an object of the present invention to devise a low frequency acoustic absorber which reduces the low frequency resonance modes typical of a rectangular room.

It is another object of the invention to improve the quality of a reproduced audio event on a playback system in a generally rectangular room.

DISCLOSURE OF INVENTION

The above objects have been met by an electrically active sound pressure reduction apparatus, located in or near the region where high pressure components of standing waves are formed. A cylindrical housing has at one or two opposed ends an input transducer, such as a microphone, an amplifier, and an output transducer, such as a speaker. The input transducer senses incoming sound waves reflected from walls or barriers in a room or other confined volume interacting with outgoing sound waves from the output transducer. The interfering waves create increased sound pressure above ambient pressure, usually atmospheric pressure. A microphone may serve as the input transducer which, after sensing the increased sound pressure, sends its signal to an amplifier which inverts the signal and drives the output transducer in such a way as to cancel the pressure sensed by the microphone. The loop that is created depends mostly on the quality of the microphone, as any distortion produced by the amplifier and the output transducer are reduced by the feedback of the system. The electronic circuit must compensate for the amplitude and phase response of the input transducer and output transducer so as to assure loop stability while attenuating resonant acoustic waves. A loudspeaker may serve as the output transducer. The combination of microphone, amplifier, loudspeaker and control loop forms what will be known as a pressure reduction module.

In an embodiment of the present invention an upright cylindrical housing is used, in which two pressure reduction modules are located at either end. The modules are acoustically separated by means of a barrier. The effect of this arrangement is to produce roughly spherical zones of reduced acoustic pressure around each module. The frequency range at which these pressure reduction modules operate is from below 20 Hz to approximately 200 Hz. Placing housings in corners of a room simulates openings to an outside unbounded area and breaks up the high pressure corner patterns which support room resonance. In other words, reflected waves from corners and walls of rooms create deleterious resonance conditions because of phase and amplitude variations relative to nonreflected waves. Housings of the present invention can be placed effectively anywhere in a room, although they are most effective in corners when used to improve the performance of conventional loudspeakers. Further, resonance suppression housings have a significant benefit for bipolar types of loudspeakers, such as electrostatic or other panels which radiate front and back. Such loudspeakers have an inherent problem in reproducing low frequencies because the rear wave is out of phase with the front wave, and at low frequencies the two reach around the sides of the loudspeaker and cancel each other. By placing the present invention behind a bipolar panel one can cancel much of the rearwave and extend the perceived low frequency performance of the panel considerably.

BEST MODE FOR CARRYING OUT THE INVENTION

Figure 1:
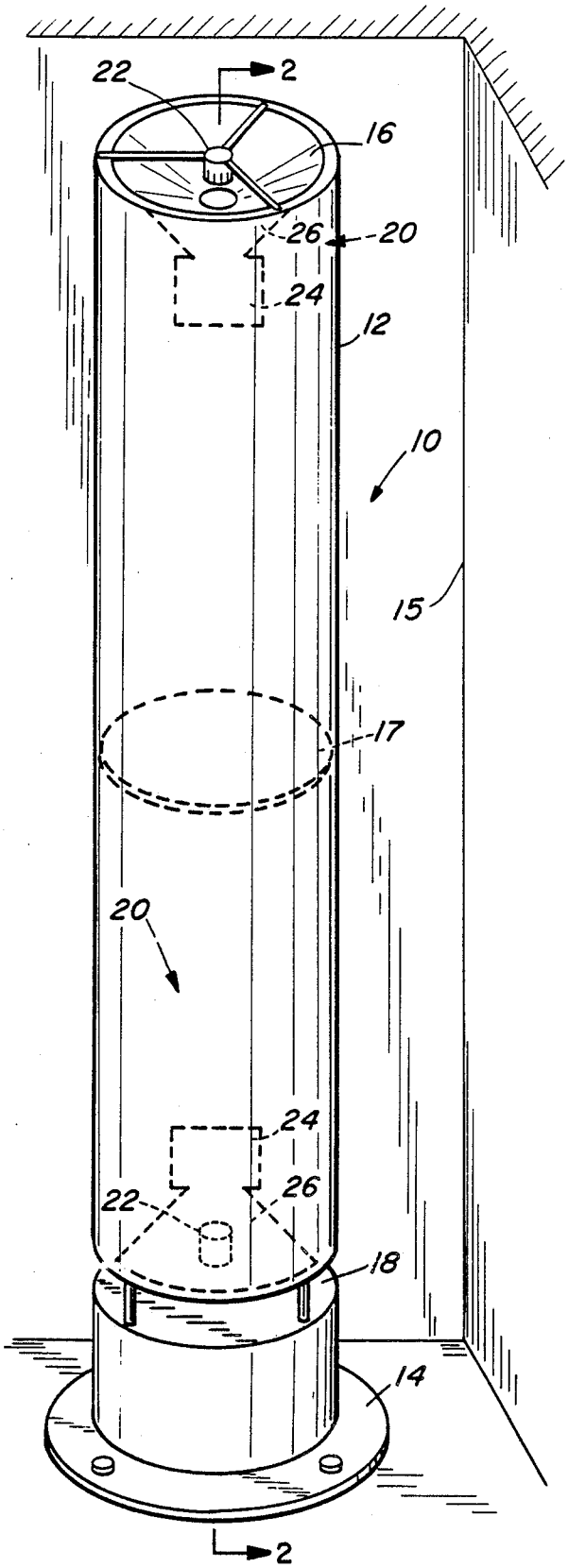
FIG. 1 is a perspective view of an embodiment of the present invention.

With reference to FIG. 1, a resonance suppressor 10 is illustrated having a hollow cylinder 12, serving as a housing. The cylinder has a top end 16 and a bottom opening 18 which are spaced by several feet, so that the housing has an elongated appearance. The ends of the cylinder are acoustically separated by sound barrier 17 located between the two ends. In operation with conventional speakers, the resonance suppressor 10 is set standing upright in a corner of a generally rectangular room 15. Base 14 provides stability so that the resonance suppressor remains upright. The preferred height for the resonance suppressor places the top end 16 of the cylinder within one foot of the ceiling. The distance of bottom opening 18 from the floor is preferably six inches. Spacing of the resonance suppressor from the sidewalls is preferably about six inches. For rooms in which bipolar speakers are used, the preferred placement of the resonance suppressor 10 would be directly behind the bipolar speakers. In this way much of the rear wave from the bipolar speaker will be canceled, and the perceived low frequency performance of the speaker will be considerably improved. The housing is preferably a free standing structure, having the appearance of an article of furniture. The housing is decorated to have a pleasing aesthetic effect in a room.

Figure 2:
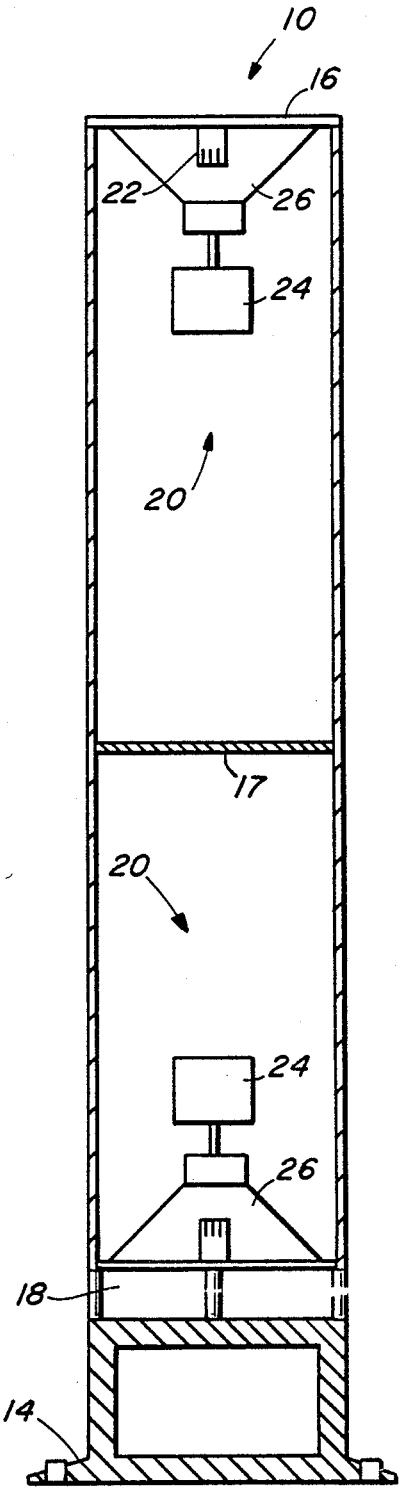
FIG. 2 is a cross sectional view taken along line 2—2 in the embodiment shown in FIG. 1.

In a preferred embodiment, cylinder end 16 and bottom opening 18 each house a resonance suppression module 20, seen in FIG. 2. Each resonance suppression module is made up of a miniature microphone 22, an amplifier and feedback control circuit 24, described in more detail with reference to FIG. 3, and a loudspeaker 26. Microphone 22 senses increased sound pressure and generates a representative input signal which is sent into amplifier and feedback control circuit 24, which in turn produces an output signal which is fed to loudspeaker 26.

The microphone must be in very close proximity to the speaker to prevent unstable feedback. For low frequencies, the microphone is preferably spaced less than three inches and preferably about one inch forward of the base of the speaker cone. Greater forward spacing causes the microphone to become more than 90° out of phase with the loudspeaker which leads to unstable feedback. At this position, the microphone is able to sense deleterious reflected waves coming from walls and corners causing increased pressure.

The amplifier is designed to offset, in phase and amplitude, the standing waves or pressure build-up as sensed by microphone 22. In operation, when microphone 22 senses a positive pressure the speaker cone is caused to move relatively away from the microphone, thus lowering the pressure to a constant pressure which, ideally, would be atmospheric pressure. Conversely, when a negative pressure is sensed by the microphone, the speaker cone is caused to move relatively toward the microphone, thus increasing the pressure. The effect is to cancel and break up standing sound pressure waves near the loudspeaker. Microphone 22 may be a high quality condenser microphone. The feedback control loop must contain circuitry to compensate for the amplitude and phase response of the transducer or loudspeaker so as to assure loop stability.

Figures 3, 4, 5:
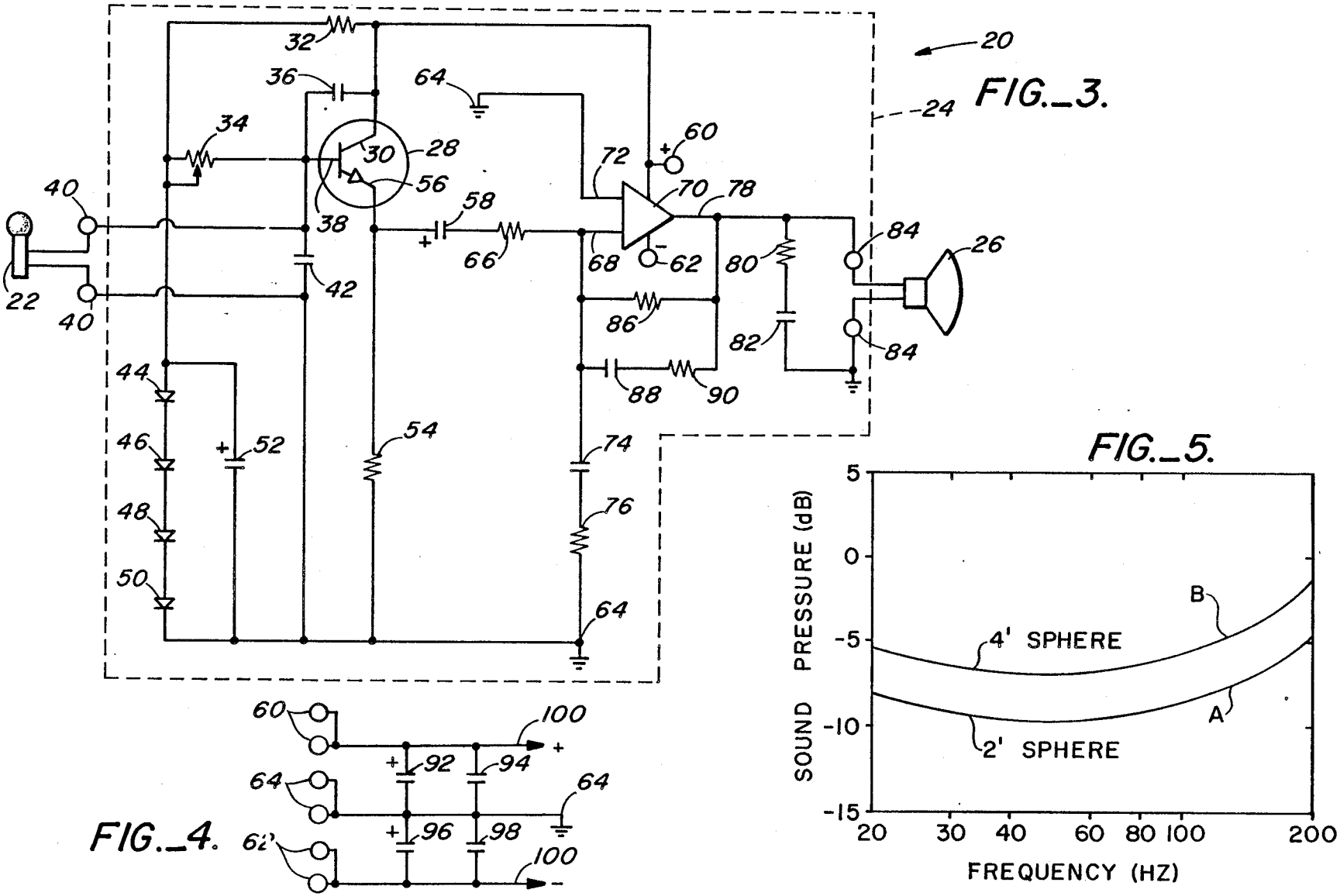
FIG. 3 is a schematic of an electrical plan in accord with the present invention.
FIG. 4 is a power supply schematic for connecting two modules of the present invention.
FIG. 5 is a plot depicting sound pressure reduction performance of the embodiment of FIG. 1.

The feedback circuit of FIG. 3 includes input transistor 28, wherein collector 30 is connected to positive voltage supply 60. Input transistor 28 may be a field effect transistor. Fixed resistor 32 and variable resistor 34 establish bias for base 38. High frequency bypass capacitor 36 is a low impedance path for a.c. signals between base 38 and collector 30. Microphone input 40 is placed across capacitor 42, with one side of the input 40 connected to ground 64 and the other side connected to base 38. Diodes 44–50 are connected in series and are in the parallel circuit with capacitor 52 connected between ground 64 and resistor 34, thereby providing a reference to the resistor and bias voltage for condenser microphone circuit. Resistor 54 is connected between ground 64 and emitter 56 for providing a reference for emitter 56, making transistor 28 an emitter follower amplifier. Capacitor 58 and resistor 66 are connected between emitter 56 and the negative input 68 of operational amplifier 70 for conducting an output signal from transistor 30 to amplifier 70. The positive input 72 to amplifier 70 is connected to ground reference 64. Capacitor 74 and resistor 76 are connected between the negative input 68 and ground reference 64. The output 78 of amplifier 70 is connected to resistor 80 in series with capacitor 82 which are in parallel with the loudspeaker output terminals 84 and is also connected through the feedback path including resistor 86 in parallel with capacitor 88 and resistor 90 to the negative input 68. Resistor 90 and capacitors 42, 36 and 88 provide loop stability compensation. The output across terminals 84 is the inverse of the input signal.

FIG. 4 depicts a sample circuit connecting a power supply to two pressure reduction modules. Capacitors 92 and 94 are connected between positive voltage supply 60 and reference voltage 64. Capacitors 96 and 98 are connected in parallel between negative voltage supply 62 and reference voltage 64. Outputs 100 go to the two pressure reduction modules.

The plot of FIG. 5 illustrates the sound pressure reduction achieved by the present invention. The effect of the pressure reduction modules is to create roughly spherical zones of reduced sound pressure which simulate openings to an outside unbounded area and thus break up the high pressure corner patterns which support room resonance. Curve A depicts the pressure reduction at a distance of two feet from the module. The pressure reduction between 20 and 200 Hz for curve A ranges between 5 and 10 dB. The greatest reduction occurs between 40 and 60 Hz. A similar pressure reduction takes place at a distance of four feet from the module, only the reduction is less, as shown by curve B. At four feet the pressure reduction ranges from about 2 dB at 200 Hz to 7 dB at 50 Hz.

While the present invention has been described with reference to a microphone and speaker as input and output devices, other devices which behave analogously, such as crystals or membranes, may also be used as input and output means. While the speaker has been described as having a cone as the sound producing element, a conical shape for the cone is not essential. Other shapes such as ellipses, parabolas and the like may be superior to a conical shape, yet should be understood to be within the meaning of the word "cone".

I claim:

1. An active acoustic system for low frequency resonance attenuation for an enclosed volume, such as a room, the system comprising:

an elongated housing having opposed ends;

a speaker being mounted in the housing and having a cone with an axial base with speaker drive provided to the base for generating outbound sound waves from the housing into the enclosed volume;

input means having first and second signal terminals and being located forward of the cone, for sensing incoming sound waves that form an increased pressure zone with pressure above ambient pressure and for generating an electrical input signal in response to the increased sound pressure in the increased pressure zone;

signal processing means, for receiving the electrical input signal, for generating an inverse signal relative to the input signal, and for communicating the inverse signal to the cone, thereby producing outbound sound waves that offset the increased pressure in the increased pressure zone; and feedback means within said signal processing means adjusting the level of the inverse signal to a desired level, where the feedback means has a feedback impedance that is finite and positive for dc signals and that decreases in magnitude with increasing input signal frequency.

2. An acoustic resonance attenuation apparatus comprising an elongated housing having a first acoustic resonance attenuation system in accord with claim 1, said first system being situated near one end of the housing, said housing having a second acoustic resonance attenuation system in accord with claim 1 near the opposite end of the housing.

3. The system of claim 1 wherein said input means is a microphone.

4. The system of claim 3 wherein said microphone is mounted centrally in said speaker cone less than three inches from the base of the cone.

5. The system of claim 1 wherein said housing comprises a cylindrical hollow tube having two opposing ends, said tube being internally sound dampened.

6. The system of claim 1, wherein said signal processing means and said feedback means together comprise:

voltage bias means having a first terminal and having a grounded second terminal, for establishing a selected voltage difference between its first and second terminals;

a first capacitor having first and second terminals connected to the first and second terminals, respectively, of the voltage difference means;

a pnp transistor having a collector terminal, a base terminal and an emitter terminal, having its emitter connected to ground through a first resistor;

a second resistor of variable resistance having a first terminal connected to the base of the transistor and having a second terminal connected to the first terminal of the voltage difference means;

a second capacitor having a first terminal connected to the base of the transistor and having a grounded second terminal;

a third capacitor having first and second terminals connected to the collector and base, respectively, of the transistor;

a feedback amplifier means having two input terminals and an output terminal a with a first input terminal grounded, for receiving at its second input terminal a signal produced at the emitter of the transistor and for producing at its output terminal an amplification of the signal received, the feedback amplifier means having a feedback impedance that is finite and positive for dc signals and the decreases in magnitude with increasing input signal frequency;

a fourth capacitor and a third resistor connected in series between the emitter of the transistor and the second input terminal of the feedback amplifier means;

a fourth resistor and a fifth capacitor, connected in series between the second input terminal of the feedback amplifier means and ground;

a fifth resistor and a sixth capacitor, connected in series between the output terminal of the feedback amplifier means and ground;

where said speaker has first and second terminals that are connected, respectively, to ground and to the output terminal of the feedback amplifier means; and where said first and second terminals of said input means are connected, respectively, to ground and to the base of the transistor.

7. The system of claim 6, wherein said feedback amplifier means comprises:

an operational amplifier having a first input terminal that is grounded, having a second input terminal and having an output terminal;

a sixth resistor connected at first and second terminals to the second input terminal and the output terminal, respectively, of said feedback amplifier means; and a seventh resistor and a seventh capacitor, connected in series between the output terminal and the second input terminal of said feedback amplifier means.

8. An active acoustic system for low frequency resonance attenuation at two spaced apart positions in an enclosed volume, such as a room, the system comprising:

an elongated housing that is internally sound dampened and has first and second ends;

a first speaker mounted at the first end of the housing and a second speaker mounted at the second end of the housing, each speaker having associated therewith:

a cone with an axial base with speaker drive provided to the base for generating outbound sound waves from the housing into the enclosed volume;

input means having first and second signal terminals and being located forward of the cone, for sensing incoming sound waves that forms an increased pressure zone with pressure above ambient pressure and for generating an electrical input signal in response to the increased sound pressure in the increased pressure zone;

signal processing means, for receiving the electrical input signal, for generating an inverse signal relative top the input signal, and for communicating the inverse signal to the cone, thereby producing outbound sound waves that offset the increased pressure in the increased pressure zone; and feedback means included within said processing means for adjusting the level of the inverse signal to a desired level, where the feedback means has a feedback impedance that is finite and positive for dc signals and that decreases in magnitude with increasing input signal frequency, where the first and second ends of the housing are positioned adjacent to the two positions at which attenuation is desired and the two speakers are independently operable.

9. The system of claim 8 wherein at least one of said signal processing means and at least one of said feedback means together comprise:

voltage bias means having a first terminal and having a grounded second terminal, for establishing a selected voltage difference between its first and second terminals;

a first capacitor having first and second terminals connected to the first and second terminals, respectively, of the voltage difference means;

a pnp transistor having a collector terminal, a base terminal and an emitter terminal, having its emitter connected to ground through a first resistor;

a second resistor of variable resistance having a first terminal connected to the base of the transistor and having a second terminal connected to the first terminal of the voltage difference means;

a second capacitor having a first terminal connected to the base of the transistor and having a grounded second terminal;

a third capacitor having first and second terminals connected to the collector and base, respectively of the transistor;

a feedback amplifier means having two input terminals and an output terminal with a first input terminal grounded, for receiving at its second input terminal a signal produced at the emitter of the transistor and for producing at its output terminal an amplification of the signal received, the feedback amplifier means having a feedback impedance that is finite and positive for dc signals and that decreases in magnitude with increasing input signal frequency;

a fourth capacitor and a third resistor connected in series between the emitter of the transistor and the second input terminal of the feedback amplifier means;

a fourth resistor and a fifth capacitor, connected in series between the second input terminal of the feedback amplifier means and ground;

a fifth resistor and a sixth capacitor, connected in series between the output terminal of the feedback amplifier means and ground;

where said speaker has first and second terminals that are connected, respectively, to ground and to the output terminal of the feedback amplifier means; and where said first and second terminals of said input means are connected, respectively, to ground and to the base of the transistor.

10. The system of claim 9, wherein said feedback amplifier means comprises:

an operational amplifier having a first input terminal that is grounded, having a second input terminal and having an output terminal:

a sixth resistor connected at first and second terminals to the second input terminal and the output terminal, respectively, of said feedback amplifier means; and a seventh resistor and a seventh capacitor, connected in series between the output terminal and the second input terminal of said feedback amplifier means.

* * * * *